US009192019B2

(12) United States Patent
Huizenga et al.

(10) Patent No.: US 9,192,019 B2
(45) Date of Patent: Nov. 17, 2015

(54) SYSTEM FOR AND METHOD OF COMMISSIONING LIGHTING DEVICES

(71) Applicant: ABL IP Holding LLC, Conyers, GA (US)

(72) Inventors: Charlie Huizenga, Berkeley, CA (US); John Douglas Paton, Piedmont, CA (US); Zachary Smith, San Francisco, CA (US); Michael G. Corr, San Francisco, CA (US); Mahathi Sudini, Union City, CA (US); Peter Schmuckal, Redwood City, CA (US)

(73) Assignee: ABL IP Holding LLC, Atlanta, GA (US)

( * ) Notice: Subject to any disclaimer, the term of this patent is extended or adjusted under 35 U.S.C. 154(b) by 364 days.

(21) Appl. No.: 13/694,455

(22) Filed: Dec. 4, 2012

(65) Prior Publication Data

US 2013/0147366 A1 Jun. 13, 2013

Related U.S. Application Data

(60) Provisional application No. 61/567,633, filed on Dec. 7, 2011.

(51) Int. Cl.
*H05B 37/02* (2006.01)

(52) U.S. Cl.
CPC ..... *H05B 37/02* (2013.01); *H05B 37/0272* (2013.01)

(58) Field of Classification Search
CPC ..... H05B 37/02; H05B 37/0227; H05B 37/0245; H05B 37/0218; H05B 37/029; H05B 37/0272
See application file for complete search history.

(56) References Cited

U.S. PATENT DOCUMENTS

| | | | |
|---|---|---|---|
| 3,733,528 | A | 5/1973 | Gilbreath |
| 3,735,141 | A | 5/1973 | Beling |
| 4,242,614 | A | 12/1980 | Vatis et al. |
| 4,323,820 | A | 4/1982 | Teich |
| 4,347,461 | A | 8/1982 | Carlson |
| 4,355,309 | A | 10/1982 | Hughey et al. |
| 4,358,717 | A | 11/1982 | Elliott |
| 4,388,567 | A | 6/1983 | Yamazaki et al. |
| 4,454,509 | A | 6/1984 | Buennagel et al. |
| 4,686,380 | A | 8/1987 | Angott |
| 4,797,599 | A | 1/1989 | Ference et al. |
| 4,889,999 | A | 12/1989 | Rowen |
| 5,005,211 | A | 4/1991 | Yuhasz |
| 5,146,153 | A | 9/1992 | Luchaco et al. |
| 5,237,264 | A | 8/1993 | Moseley et al. |

(Continued)

OTHER PUBLICATIONS

Adams, J.T., "Wireless Sensors and Controls Make the Organic Building," May 2006, Proceedings of the 2006 IEEE Intl. Symposium on Electronics and the Environment, pp. 109-113.

(Continued)

*Primary Examiner* — Jung Kim
(74) *Attorney, Agent, or Firm* — Carr & Ferrell LLP

(57) ABSTRACT

A lighting system for and method of commissioning LED light fixtures is disclosed. The LED light fixtures include a controller unit that is programmed with lighting firmware and an on-board light sensor that is responsive to visible light signals from a light source. In operation, the light sensor is irradiated visible light signals and/or visible light sequences that instruct the LED light fixture via the controller unit to join a group, be locked into a group, run lighting programs and/or become un-locked from a group.

11 Claims, 4 Drawing Sheets

(56) References Cited

U.S. PATENT DOCUMENTS 5,248,919 A 9/1993 Hanna et al.
5,268,631 A 12/1993 Gorman et al.
5,357,170 A 10/1994 Luchaco et al.
5,373,453 A 12/1994 Bae
5,471,063 A 11/1995 Hayes et al.
5,561,351 A 10/1996 Vrionis et al.
5,572,438 A 11/1996 Ehlers et al.
5,637,930 A 6/1997 Rowen et al.
5,770,926 A 6/1998 Choi et al.
5,818,128 A 10/1998 Hoffman et al.
5,822,012 A 10/1998 Jeon et al.
5,872,429 A 2/1999 Xia et al.
5,905,442 A 5/1999 Mosebrook et al.
5,909,087 A 6/1999 Bryde et al.
5,927,603 A 7/1999 McNabb
5,962,989 A 10/1999 Baker
5,982,103 A 11/1999 Mosebrook et al.
6,025,783 A 2/2000 Steffens, Jr.
6,044,062 A 3/2000 Brownrigg et al.
6,100,653 A 8/2000 Lovell et al.
6,108,614 A 8/2000 Lincoln et al.
6,148,306 A 11/2000 Seidl et al.
6,169,377 B1 1/2001 Bryde et al.
6,175,860 B1 1/2001 Gaucher
6,184,622 B1 2/2001 Lovell et al.
6,249,516 B1 6/2001 Brownrigg et al.
6,252,358 B1 6/2001 Xydis et al.
6,297,724 B1 10/2001 Bryans et al.
6,300,727 B1 10/2001 Bryde et al.
6,301,674 B1 10/2001 Saito et al.
6,311,105 B1 10/2001 Budike, Jr.
6,323,781 B1 11/2001 Hutchison
6,388,399 B1 5/2002 Eckel et al.
6,400,280 B1 6/2002 Osakabe
6,439,743 B1 8/2002 Hutchison
6,441,750 B1 8/2002 Hutchison
6,450,662 B1 9/2002 Hutchison
6,473,002 B1 10/2002 Hutchison
6,474,839 B1 11/2002 Hutchison
6,504,266 B1 1/2003 Ervin
6,510,369 B1 1/2003 Lacy
6,527,422 B1 3/2003 Hutchison
6,535,859 B1 3/2003 Yablonowski et al.
6,548,967 B1 4/2003 Dowling et al.
6,614,358 B1 9/2003 Hutchison et al.
6,633,823 B2 10/2003 Bartone et al.
6,640,142 B1 10/2003 Wong et al.
6,676,831 B2 1/2004 Wolfe
6,689,050 B1 2/2004 Beutter et al.
6,700,334 B2 3/2004 Weng
6,775,588 B1 8/2004 Peck
6,803,728 B2 10/2004 Balasubramaniam et al.
6,891,838 B1 5/2005 Petite et al.
6,904,385 B1 6/2005 Budike, Jr.
6,914,395 B2 7/2005 Yamauchi et al.
6,914,893 B2 7/2005 Petite
6,927,546 B2 8/2005 Adamson et al.
6,990,394 B2 1/2006 Pasternak
7,006,768 B1 2/2006 Franklin
7,039,532 B2 5/2006 Hunter
7,042,170 B2 5/2006 Vakil et al.
7,045,968 B1 5/2006 Bierman et al.
7,054,271 B2 5/2006 Brownrigg et al.
7,079,808 B2 7/2006 Striemer
7,103,511 B2 9/2006 Petite
7,167,777 B2 1/2007 Budike, Jr.
7,199,530 B2 4/2007 Vakil et al.
7,202,613 B2 4/2007 Morgan et al.
7,221,110 B2 5/2007 Sears et al.
7,233,080 B2 6/2007 Garnault et al.
7,263,073 B2 8/2007 Petite et al.
7,274,975 B2 9/2007 Miller
7,307,389 B2 12/2007 Vakil et al.
7,307,542 B1 12/2007 Chandler et al.
7,333,880 B2 2/2008 Brewster et al.
7,339,466 B2 3/2008 Mansfield et al.
7,346,433 B2 3/2008 Budike, Jr.
7,349,766 B2 3/2008 Rodgers
7,352,972 B2 4/2008 Franklin
7,354,175 B2 4/2008 Culbert et al.
7,356,308 B2 4/2008 Hamada et al.
7,369,060 B2 5/2008 Veskovic et al.
7,400,226 B2 7/2008 Barrieau et al.
7,417,556 B2 8/2008 Ling
7,432,803 B2 10/2008 Fails et al.
7,446,671 B2 11/2008 Giannopoulos et al.
7,490,957 B2 2/2009 Leong et al.
7,491,111 B2 2/2009 Ghaly
7,528,503 B2 5/2009 Rognli et al.
7,550,931 B2 6/2009 Lys et al.
7,561,977 B2 7/2009 Horst et al.
7,565,227 B2 7/2009 Richard et al.
7,571,063 B2 8/2009 Howell et al.
7,599,764 B2 10/2009 Matsuura et al.
7,606,639 B2 10/2009 Miyaji
7,623,042 B2 11/2009 Huizenga
7,650,425 B2 1/2010 Davis et al.
7,659,674 B2 2/2010 Mueller et al.
7,677,753 B1 3/2010 Wills
7,697,927 B1 4/2010 Owens
7,706,928 B1 4/2010 Howell et al.
7,719,440 B2 5/2010 Delp et al.
7,755,505 B2 7/2010 Johnson et al.
7,760,068 B2 7/2010 Hatemata et al.
7,783,188 B2 8/2010 Clark
7,812,543 B2 10/2010 Budike, Jr.
7,839,017 B2 11/2010 Huizenga et al.
7,843,353 B2 11/2010 Pan et al.
7,860,495 B2 12/2010 McFarland
7,880,394 B2 2/2011 Sibalich et al.
7,884,732 B2 2/2011 Huizenga
7,889,051 B1 2/2011 Billig et al.
7,902,759 B2 3/2011 Newman, Jr.
7,925,384 B2 4/2011 Huizenga et al.
7,962,054 B2 6/2011 Nakazato et al.
8,033,686 B2 10/2011 Recker et al.
8,214,061 B2 7/2012 Westrick, Jr. et al.
8,275,471 B2 9/2012 Huizenga et al.
8,344,665 B2 1/2013 Verfuerth et al.
8,364,325 B2 1/2013 Huizenga et al.
8,571,904 B2 10/2013 Guru et al.
8,588,830 B2 11/2013 Myer et al.
8,755,915 B2 6/2014 Huizenga et al.
8,854,208 B2 10/2014 Huizenga et al.
2001/0015409 A1 8/2001 Mahler et al.
2001/0025349 A1 9/2001 Sharood et al.
2002/0009978 A1 1/2002 Dukach et al.
2002/0043938 A1 4/2002 Lys
2002/0080027 A1 6/2002 Conley, III
2003/0015973 A1 1/2003 Ovens et al.
2003/0020595 A1* 1/2003 Wacyk ..... 340/3.5
2003/0209999 A1 11/2003 Hui et al.
2004/0002792 A1 1/2004 Hoffknecht
2004/0051467 A1 3/2004 Balasubramaniam et al.
2004/0100394 A1 5/2004 Hitt
2004/0130909 A1 7/2004 Mueller et al.
2004/0153207 A1 8/2004 Peck
2005/0017922 A1 1/2005 Devos et al.
2005/0030203 A1 2/2005 Sharp et al.
2005/0043862 A1 2/2005 Brickfield et al.
2005/0090915 A1 4/2005 Geiwitz
2005/0099319 A1 5/2005 Hutchison et al.
2005/0234600 A1 10/2005 Boucher et al.
2006/0001950 A1 1/2006 Fujimura et al.
2006/0044152 A1 3/2006 Wang
2006/0142900 A1 6/2006 Rothman et al.
2006/0161270 A1 7/2006 Luskin et al.
2006/0215345 A1 9/2006 Huizenga
2006/0244624 A1 11/2006 Wang et al.
2006/0291136 A1 12/2006 Okishima
2007/0005195 A1 1/2007 Pasquale et al.
2007/0057807 A1 3/2007 Walters et al.
2007/0085700 A1 4/2007 Walters et al.
2007/0090960 A1 4/2007 Miki

(56) References Cited

U.S. PATENT DOCUMENTS

| | | | | |
|---|---|---|---|---|
| 2007/0229250 | A1 | 10/2007 | Recker et al. | |
| 2007/0271006 | A1 | 11/2007 | Golden et al. | |
| 2007/0273307 | A1 | 11/2007 | Westrick et al. | |
| 2007/0276547 | A1 | 11/2007 | Miller | |
| 2007/0291483 | A1 | 12/2007 | Lys | |
| 2008/0071391 | A1 | 3/2008 | Busby et al. | |
| 2008/0075476 | A1 | 3/2008 | Nakazato et al. | |
| 2008/0133065 | A1 | 6/2008 | Cannon et al. | |
| 2008/0167756 | A1 | 7/2008 | Golden et al. | |
| 2008/0183307 | A1 | 7/2008 | Clayton et al. | |
| 2008/0242314 | A1 | 10/2008 | McFarland | |
| 2008/0258633 | A1 | 10/2008 | Voysey | |
| 2008/0265799 | A1* | 10/2008 | Sibert | 315/292 |
| 2008/0281473 | A1 | 11/2008 | Pitt | |
| 2009/0018706 | A1 | 1/2009 | Wittner | |
| 2009/0026966 | A1 | 1/2009 | Budde et al. | |
| 2009/0045941 | A1 | 2/2009 | Cooper | |
| 2009/0048691 | A1 | 2/2009 | Donaldson | |
| 2009/0055032 | A1 | 2/2009 | Rodgers | |
| 2009/0058193 | A1 | 3/2009 | Reid et al. | |
| 2009/0063257 | A1 | 3/2009 | Zak et al. | |
| 2009/0066473 | A1 | 3/2009 | Simons | |
| 2009/0072945 | A1 | 3/2009 | Pan et al. | |
| 2009/0132070 | A1 | 5/2009 | Ebrom et al. | |
| 2009/0198384 | A1 | 8/2009 | Ahn | |
| 2009/0204232 | A1 | 8/2009 | Guru et al. | |
| 2009/0218951 | A1 | 9/2009 | Weaver | |
| 2009/0222223 | A1 | 9/2009 | Walters et al. | |
| 2009/0240381 | A1 | 9/2009 | Lane | |
| 2009/0243517 | A1 | 10/2009 | Verfuerth et al. | |
| 2009/0248217 | A1 | 10/2009 | Verfuerth et al. | |
| 2009/0261735 | A1 | 10/2009 | Sibalich et al. | |
| 2009/0262189 | A1 | 10/2009 | Marman | |
| 2009/0267540 | A1 | 10/2009 | Chemel et al. | |
| 2009/0278472 | A1 | 11/2009 | Mills et al. | |
| 2009/0278934 | A1 | 11/2009 | Ecker et al. | |
| 2009/0292402 | A1 | 11/2009 | Cruickshank, III | |
| 2009/0292403 | A1 | 11/2009 | Howell et al. | |
| 2009/0299527 | A1 | 12/2009 | Huizenga et al. | |
| 2010/0039240 | A1 | 2/2010 | Rodriguez et al. | |
| 2010/0052939 | A1 | 3/2010 | Liang | |
| 2010/0066267 | A1 | 3/2010 | Meyer | |
| 2010/0114340 | A1 | 5/2010 | Huizenga et al. | |
| 2010/0134019 | A1 | 6/2010 | Berhorst | |
| 2010/0134051 | A1 | 6/2010 | Huizenga et al. | |
| 2010/0141153 | A1 | 6/2010 | Recker et al. | |
| 2010/0164386 | A1 | 7/2010 | You | |
| 2010/0179670 | A1 | 7/2010 | Forbes, Jr. et al. | |
| 2010/0185339 | A1 | 7/2010 | Huizenga et al. | |
| 2010/0191388 | A1 | 7/2010 | Huizenga | |
| 2010/0201203 | A1 | 8/2010 | Schatz et al. | |
| 2010/0204847 | A1 | 8/2010 | Leete, III et al. | |
| 2010/0207548 | A1 | 8/2010 | Iott | |
| 2010/0237783 | A1 | 9/2010 | Dupre et al. | |
| 2010/0262296 | A1 | 10/2010 | Davis et al. | |
| 2010/0265100 | A1 | 10/2010 | Jalbout et al. | |
| 2010/0327766 | A1 | 12/2010 | Recker et al. | |
| 2011/0006877 | A1 | 1/2011 | Franklin | |
| 2011/0012541 | A1 | 1/2011 | Finch | |
| 2011/0043052 | A1 | 2/2011 | Huizenga et al. | |
| 2011/0101871 | A1 | 5/2011 | Schenk et al. | |
| 2011/0109424 | A1 | 5/2011 | Huizenga et al. | |
| 2011/0112702 | A1 | 5/2011 | Huizenga et al. | |
| 2011/0121654 | A1 | 5/2011 | Recker et al. | |
| 2011/0133655 | A1 | 6/2011 | Recker et al. | |
| 2011/0175533 | A1 | 7/2011 | Holman et al. | |
| 2011/0206393 | A1 | 8/2011 | Nakazato et al. | |
| 2012/0001548 | A1 | 1/2012 | Recker et al. | |
| 2012/0020060 | A1 | 1/2012 | Myer et al. | |
| 2012/0026726 | A1 | 2/2012 | Recker et al. | |
| 2012/0043889 | A1 | 2/2012 | Recker et al. | |
| 2012/0074843 | A1 | 3/2012 | Recker et al. | |
| 2012/0080944 | A1 | 4/2012 | Recker et al. | |
| 2012/0098432 | A1 | 4/2012 | Recker et al. | |
| 2012/0098439 | A1 | 4/2012 | Recker et al. | |
| 2012/0143383 | A1 | 6/2012 | Cooperrider et al. | |
| 2012/0330476 | A1 | 12/2012 | Huizenga et al. | |
| 2013/0033183 | A1 | 2/2013 | Verfuerth et al. | |
| 2013/0103201 | A1 | 4/2013 | Huizenga et al. | |
| 2013/0113291 | A1 | 5/2013 | Recker et al. | |
| 2013/0131882 | A1 | 5/2013 | Verfuerth et al. | |
| 2013/0193847 | A1 | 8/2013 | Recker et al. | |
| 2013/0221858 | A1* | 8/2013 | Silberstein | 315/153 |
| 2013/0285558 | A1 | 10/2013 | Recker et al. | |
| 2014/0265878 | A1* | 9/2014 | Gritti | 315/153 |
| 2014/0354995 | A1 | 12/2014 | Huizenga et al. | |

OTHER PUBLICATIONS

Canovas, S. R., Chermont, M.G., and Cugnasaca, C.E., "Remote Monitoring and Actuation Based on LonWorks Technology," Jul. 2005, 2005 EFITA/WCCA Joint Congress on IT in Agriculture.

Gislason, D. and Gillman, T. "ZigBee Wireless Sensor Networks," Nov. 2004, Dr. Dobbs online journal, www.ddj.com/184405887.

Gutierrez, J.A., "On the Use of IEEE Std. 802, 15.4 to enable Wireless Sensor Networks in Building Automation," Dec. 2007, Int'l. Journal of Wireless Information Network, vol. 14, No. 4.

Kintner-Meyer, M. "Opportunities of Wireless Sensors and Controls for Building Operations," Aug.-Sep. 2005, Energy Engineering, vol. 102, No. 5, pp. 27-48.

Motegi, N., Piette, M., Kinney, S., and Herter, K., "Web-Based Energy Information Systems for Energy Management and Demand Response in Commercial Buildings," Apr. 2003, Lawrence Berkeley National Laboratory.

Park, H., Burke, J., and Srivastava, M., "Design and Implementation of a Wireless Sensor Network for Intelligent Light Control," Apr. 2007, IPSN 07.

Sandhu, J.S.S., Agogino, A.M., "Wireless Sensor Networks for Commercial Lighting Control: Decision Making with Multi-Agent Systems," Jul. 2004, Workshop on Sensor Networks.

Sandhu, J.S., Agogino, A.M., and Agogino, A.K., "Wireless Sensor Networks for Commercial Lighting Control: Decision Making with Multi-Agent Systems," 2004, American Association for Artificial Intelligence.

Singhvi, V., Krause, A., Guestrin, C., Garrett, J.H., Matthews, H.S. "Intelligent Light Control Usine Sensor Networks," Nov. 2005, SenSys 2005.

Teasdale, D., Rubinstein, F., Watson, D., and Purdy, S., "Annual Technical Progress Report: Adapting Wireless Technology to Lighting Control and Environmental Sensing," Oct. 2005, Dust Networks, Annual Technical Progress Report.

Wang, D., Arens, E., and Federspiel, C., "Opportunities to Same Energy and Improve Comfort by Using Wireless Sensor Networks in Buildings," Oct. 2003, Proceedings of the third intl Conference for Enhanced Building Operations.

Sekinger, J., "Wireless Lighting Control Technology," Oct. 2005, Phillips NAESCO Midwest Regional Mtgs.

* cited by examiner

SYSTEM FOR AND METHOD OF COMMISSIONING LIGHTING DEVICES

RELATED APPLICATION

This application claims priority under 35 U.S.C. 119(e) from the U.S. provisional patent application Ser. No. 61/567,633, filed on Dec. 7, 2011, and titled "LIGHTING CONTROL CONFIGURATION." The provisional patent application Ser. No. 61/567,633, filed on Dec. 7, 2011, and titled "LIGHTING CONTROL CONFIGURATION" is hereby incorporated by reference.

FIELD OF THE INVENTION

This invention relates to lighting systems. More specifically, this relates to controllers for controlling lighting and devices and methods for commissioning and programming the same.

BACKGROUND OF THE INVENTION

Wireless lighting control systems allow switches, lighting fixtures, motion sensors and light sensors, hereafter lighting devices, to be joined in groups and operate in a cooperative fashion to provide suitable lighting conditions based on any number of conditions. For example, lighting devices in a particular group are instructed to be cooperatively responsive to occupancy, ambient light, time of the day and power usage on a power grid, and operation of other lighting devices inside or outside of the group, to name a few. Lighting devices, or a portion of the lighting devices, within the wireless lighting control system are configured to initiate particular lighting sequences and/or run particular programs imbedded within their firmware. The process of grouping lighting devices within the wireless lighting control system to operate collectively in response to conditions, initiate particular lighting sequences and/or run particular programs, is referred to herein as commissioning.

The lighting devices in the wireless lighting control systems employ radio transmissions to provide communication signals between the lighting devices. The lighting devices, or a portion thereof, include a micro-processor coded with firmware that instructs one or more control circuits to operate the light fixtures within the wireless lighting control system to respond to one or more of the conditions, mentioned above.

While these wireless lighting control systems provide the flexibility to generate any number of lighting scenarios with reduced energy consumption and cost, commissioning of the lighting devices within a wireless lighting control system can be complicated. Typically, each of the lighting devices needs to be placed into a commissioning mode and then instructed to join a group and run particular program sequences. This is accomplished, for example, by executing a prescribed press and/or press and hold button sequence on each device. Typically, these sequences require the ability to access or touch a lighting fixture which will typically require the use of a ladder or other device to reach the fixture. In some more sophisticated wireless lighting control systems, lighting devices are capable of being commissioned remotely over a network. Regardless, these commissioning procedures are difficult for electricians or installers to perform properly. Accordingly, setting up a wireless lighting control system usually require that a specialized technician perform the commissioning of lighting devices after the wireless lighting control systems is installed by the electrician or installer. Wireless controls network typically require a separate master device to coordinate the network. This master device adds cost and complexity to the wireless network. Not requiring this master device greatly simplifies the installation and support of this network.

SUMMARY OF THE INVENTION

A lighting system of the present invention includes lighting devices that are grouped to cooperatively operate over a wireless network, or wireless lighting control network, in response to a condition. A wireless network, or wireless lighting control network, herein refers to the network or medium through which control signals and operational data are transmitted between the lighting devices, control devices, computers and/or servers. Typically, control signals and operational data are transmitted between the lighting devices, control devices, computers and/or servers using radio packet transmissions. Details of preferred wireless networks, or wireless lighting control networks are provided in U.S. patent application Ser. No. 12/156,621, filed Jun. 2, 2008 and titled "DISTRIBUTED INTELLIGENCE IN LIGHTING CONTROL," the contents of which is hereby incorporated by reference.

Lighting devices within the network generally include switches, light fixtures, motion detectors that control lighting levels in response to one or more conditions, such as occupancy detection, ambient light, occupant preference, automatic schedules that direct actions at a given time of the day and electrical utility signals and control signals transmitted from a control device. The process of "grouping" lighting devices to cooperatively operate in response to the one or more conditions, locking the lighting devices to cooperatively operate within a fixed group and/or initiating lighting devices to run lighting programs is referred to herein as commissioning.

The present invention provides a method of commissioning lighting devices that does not require the commissioning agent to physically touch the lighting device as would be required for pressing a button located on a lighting device or control device. The present is used to commission lighting device to join a group of lighting devices and cooperatively operate in response to a condition. The present invention is also used to create new groups and close groups of lighting device from a lighting device, such that the lighting devices cooperatively operate in response to a condition. Joining groups of lighting device, creating new groups of lighting device and closing groups of lighting device to cooperatively operate in response to a condition is also referred to herein as a process of commissioning lighting devices.

While the lighting devices are all configured to ultimately control lighting from light fixtures that are electrically coupled to a load circuit, not all of the lighting devices are necessary electrically coupled to, or powered by, a load circuit. For example, control devices, switches, motion sensors and other sensors within the network can be battery powered, solar powered and/or powered by any other suitable means. Details of a wireless sensor, for example, are provided in the U.S. patent application Ser. No. 12/940,902, filed Nov. 5, 2010 and titled "WIRELESS SENSOR," contents of which is hereby incorporated by reference.

In accordance with the method of the present invention commissioning lighting devices to join a group of light fixtures within a wireless network is accomplished by transmitting group information over the wireless network. The group information is transmitted over the wireless network by actuating a momentary switch on a lighting device within the wireless network or irradiating a light sensor on one or more of the lighting devices within the wireless network with a visible commissioning light signal, such as described in detail below. The group information is received by radio transceivers on the lighting devices within the wireless network. Once the group information is received by the lighting devices, irradiating light sensors on each of the lighting devices with a first visible commissioning light signal instructs or results in the lighting devices to join the group. Once the lighting device within the wireless network join the group, irradiating at least one of the light sensors on the lighting devices with a second visible light signal closes the group.

In accordance with the method of the present invention a group lighting devices is created within the network by irradiating a light sensor on one or more of the lighting device with a first visible commissioning light signal from a light source. The light sensor is electrically coupled to a micro-processor with a memory unit with firmware loaded thereon (also referred to herein as a control circuit). When the light sensor is irradiated with the first visible commissioning light signal, the micro-processor instructs the lighting device associated with the light sensor and control circuit to create a new group of lighting devices. The lighting device broadcasts a unique group code or group address for subsequent device to receive.

In accordance with the method of the present invention, additional lighting devices are commissioned within the network by irradiating a light sensor with a second visible commissioning light signal from a light source. The lighting device captures and stores the group code or group address. The group is then closed by irradiating a light sensor with a third visible commissioning light signal.

Regardless of how the group is selected or determined, then a light sensor of any group member is irradiated with a visible commissioning light signal from the light source to close the group. When the light sensor senses the close the group signal, the micro-processor then instructs the lighting device and its group members to close the group and commence operation as a group. The lighting device will then respond cooperatively to control commands, operational data and/or conditions of other lighting devices within the group. While all of the commissioning signals can have the same wavelength, preferably the light sensor is capable of differentiating and responding differently to light having different wavelengths.

The method of commissioning a lighting device described above is preferably performed on light fixtures. However, it will be clear to one skilled in the art from the description above and below that the present invention can also be used to commission other lighting devices within a wireless lighting control network including, but not limited to, switches, motion sensors, light sensors and control devices.

Where the lighting device is a light fixtures, in addition to the elements of a light sensor that is electrically coupled to a micro-processor with a memory unit with firmware loaded thereon, the light fixture also includes a driver circuit for powering a light engine and radio transducer. The light engine is a fluorescent light engine, an LED light engine or a combination thereof. The light sensor for commissioning a light fixture, the control circuit and the radio transducer, are collectively referred to, herein as the controller.

In accordance with the embodiments of the invention, the light sensor used to receive or detect the visible light commissioning signals, described above, measures and reports the spectral content of the visible light including reporting on narrower regions of the visible spectrum in portions of the spectrum generally described as red, green and blue. The light sensor may also be capable of calculating color temperature. Preferably, the light sensor is selectively responsive to monochromatic high intensity visible light commissioning signals. The information received from the light sensor may also be used by the controller to signal the light fixture increase or decrease the light emitted in response to ambient light levels.

A suitable light source for generating the visible commissioning light signals is a smart phone, an led light source and/or a laser light source. Preferably, the light source is highly portable and easily carried from lighting fixture to lighting fixture and is capable of generating a first visible commissioning light signal and the second visible commissioning light signals having different wavelengths. Most preferably, the light source is a high intensity light source that generates mono-chromatic light, such as dual-color hand-held laser. For example, a dual-color hand-held laser is configured to generate red light with a first laser source and green light with second laser source.

In accordance with yet further embodiments of the invention, the light source is configured to generate visible commissioning light sequences. The visible commissioning light sequences have any number of functions. However, preferably one or more visible commissioning light sequences are used to irradiate the light sensor and initiate a lighting program after the corresponding light fixture is instructed to join a group and before the light fixture is locked into the group. In addition, visible commissioning light sequences are used to irradiate the light sensor and initiate the micro-processor on the corresponding light fixture to un-locked the light fixture from the group, thus allowing the light fixture to be re-commissioned into a different group and/or instructed to run a lighting program, such as described above.

In yet further embodiments of the invention, the controller unit of the light fixture includes a momentary switch. During the setup process, this switch may be used to manually set the maximum light output of all of the lighting fixtures within the wireless group. When the group is being formed or has been reopened, the momentary switch may be pressed to initiate a set of commands to limit the output of all group members. During this process, each subsequent press or other command will reduce the maximum light output by a set increment on the immediate fixture and all group members. When the desired level is reached, the maximum light output can be set by initiating another command such as a press and hold command. This command sets the maximum level for the immediate fixture and all group members. When the lighting group is placed back into operational mode, the light output from the lighting fixtures will now not exceed the maximum setting. In the future, when new members join the group then this maximum level information will be shared with the new members of the group.

DETAILED DESCRIPTION OF THE INVENTION

Figure 1:
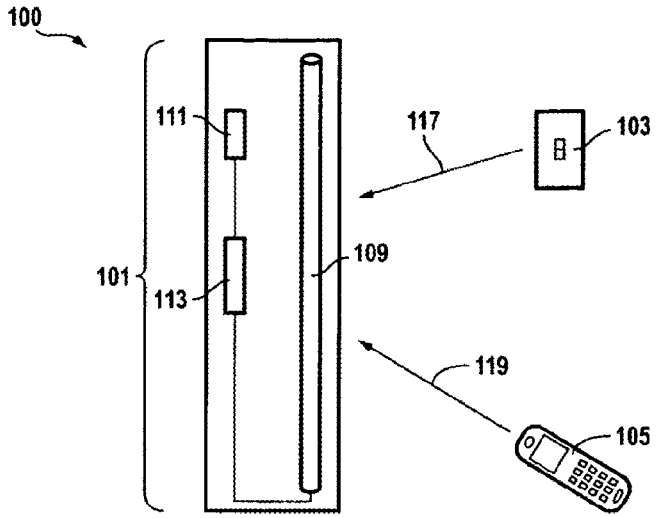
FIG. 1 shows schematic representation of a light fixture with a wireless controller for operating in a wireless lighting network, in accordance with the embodiments of the invention.

FIG. 1 shows schematic representation 100 of a light fixture 101 with a wireless controller 111 for operating in a wireless lighting network (not shown). The light fixture 101 also includes a driver circuit 113 for powering a light engine 109. Controller 111 and driver circuit 113 may be discrete devices or controller 111 may be embedded inside Controller 111. In operation controlling devices, such as a switch 103 or a hand-held remote 105 are configured to send out command signals, indicated by the arrows 117 and 119, respectively. Command signals instruct the light fixture 101 to turn on and off, to dim and/or run lighting programs. The wireless controller 111 includes a wireless radio transmitter and receiver (transducer) for communicating with the control devices 103 and 105 and for sending out operational data to other lighting devices (not shown) in the wireless lighting network. The controller 111 also includes a micro-processor and a memory unit loaded with firmware configured to execute the command signals from the control devices 103 and 105.

Figure 2:
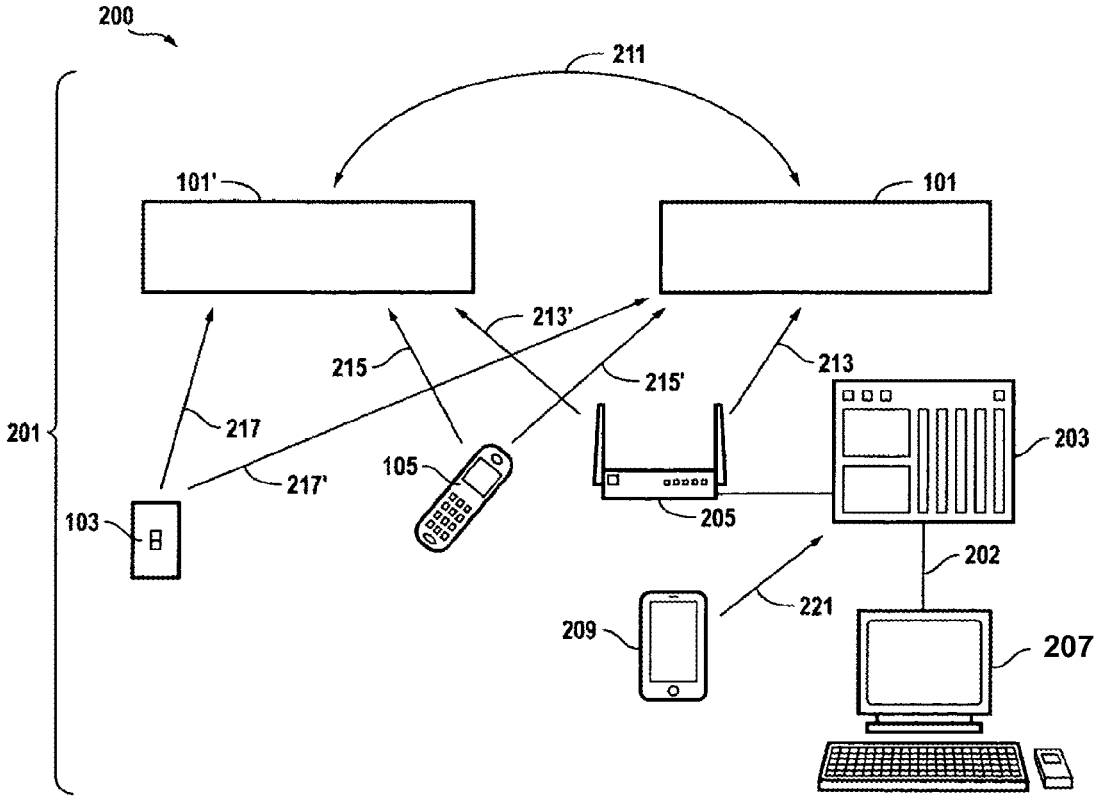
FIG. 2 shows a schematic representation of a wireless lighting network, in accordance with the embodiments of the invention.

FIG. 2 shows a schematic representation 200 of a wireless lighting network 201 with light fixtures 101 and 101' operating in a group over the wireless lighting network 201. The wireless lighting network 201 includes a gateway 205 and a server 203 capable of communicating with a number of lighting devices within the wireless lighting network 201. As described above, controlling devices, such as a switch 103 or a hand-held remote 105 are configured to send command signals, as indicated by the arrows 217/217' and 215/215' to control or commission the light fixtures 101 and 101'. Also, each of the light fixtures 101 and 101' includes a control circuit with micro-processor and memory unit with firmware for executing control signals as well as wireless radio transducer for communicating with the control devices 103 and 105 and for sending out operational data between each other and to the server 203 through the gateway 205, as indicated by the arrows 213 and 213'.

While, the invention is described as operation within a wireless lighting network 201, it will be clear to one skilled in the art that a wireless lighting network 201 is not required to practice the invention. All control decision making resides within the firmware programmed into the wireless controller 111 including automatic schedules. The gateway 205 may be removed from the control system without interrupting or modifying automatic control of the lighting devices.

In operation, each of the lighting devices in the wireless lighting network 201 is capable of being mapped, displayed and controlled by a remote computer 207. History of operational data and other analytics of the operation of the wireless lighting network 201 and/or of each of the lighting devices within the wireless lighting network 201 is capable of being stored and displayed on the remote computer 207 over the server 203. Within the wireless lighting network 201 a cellular phone 209 is capable of being used as a control device. In operation the cellular phone 209 connects to the server 203 over a cellular network, as indicated by the arrow 221 and sends command signals from the cellular phone 209 to the server 203. The command signals are then transmitted to the light fixtures 101 and 101' or other lighting devices within the wireless lighting network 201 through the gateway 205.

Figure 3:
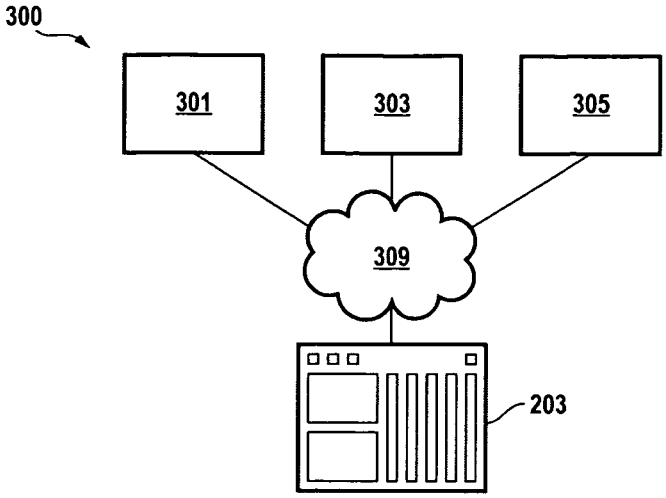
FIG. 3 shows a schematic representation of a wireless network for controlling groups or zones of lighting, in accordance with the embodiments of the invention.

FIG. 3 shows a schematic representation 300 of a wireless network for controlling groups or zones of lighting devices 301, 303 and 305. Each of the groups or zones of lighting devices, 301, 303 and 305 include lighting devices that have been commissioned to cooperatively operate in response to the one or more conditions within the group. Each of the groups or zones of lighting devices 301, 303 and 305 are preferably in communication with a server 203 over a network 309 that includes all of the necessary hardware configured to process communication protocols. Further details of lighting control networks and protocols are provided in U.S. patent application Ser. No. 12/156,621, filed Jun. 2, 2008 and titled "DISTRIBUTED INTELLIGENCE IN LIGHTING CONTROL," referenced previously.

Figure 4A:
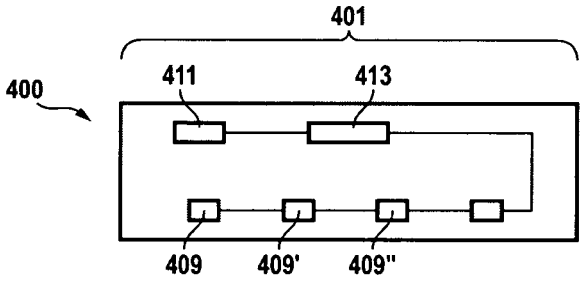
FIG. 4A shows schematic representation of an LED light fixture with a wireless controller for operating in a wireless lighting network, in accordance with the embodiments of the invention.

FIG. 4A shows schematic representation 400 of a light fixture 401, which is for example an LED light fixture 401 with a wireless controller 411 for operating in a wireless lighting network 201, such as described with reference to FIGS. 1-3. The controller 411 includes a radio transducer, a micro-processor and memory unit loaded with firmware, such as described above. The LED light fixture 401 also includes an LED driver circuit 413 for powering an LED light engine that includes any number of LEDs 409, 409' and 409". The LED driver circuit 413 provides power to the LED light engine based on command signals from control devices and/or other lighting device with a designated group of the wireless lighting network.

Figure 4B:
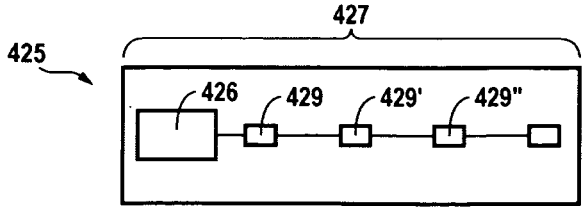
FIG. 4B shows schematic representation of an LED light fixture with a wireless controller unit that combines a controller circuit and driver circuit for operating in a wireless lighting network, in accordance with the embodiments of the invention.

FIG. 4B shows schematic representation 425 of an LED light fixture 427 with a wireless controller unit 426 for controlling and powering an LED light engine that includes LEDs 429, 429' and 429".

Figure 4C:
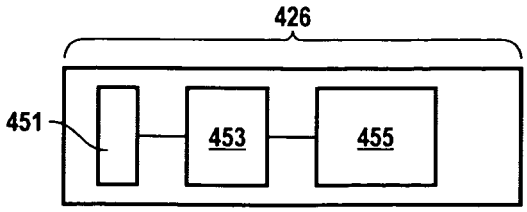
FIG. 4C shows a schematic representation of the wireless controller unit shown in FIG. 4B, in accordance with the embodiments of the invention.

Referring now to FIG. 4C, the controller unit 426 combines a controller circuit 453 and an LED driver circuit 455 into a single form factor. As described above, the controller circuit 453 includes a radio transducer, a micro-processor and memory unit loaded with firmware to run lighting programs or protocols, to execute control signals, to communicate operational data, to store usage history and/or perform any number of functions consistent with a wireless lighting control system. The controller unit 426 also includes an on-board sensor or commissioning module 451.

Figure 5A:
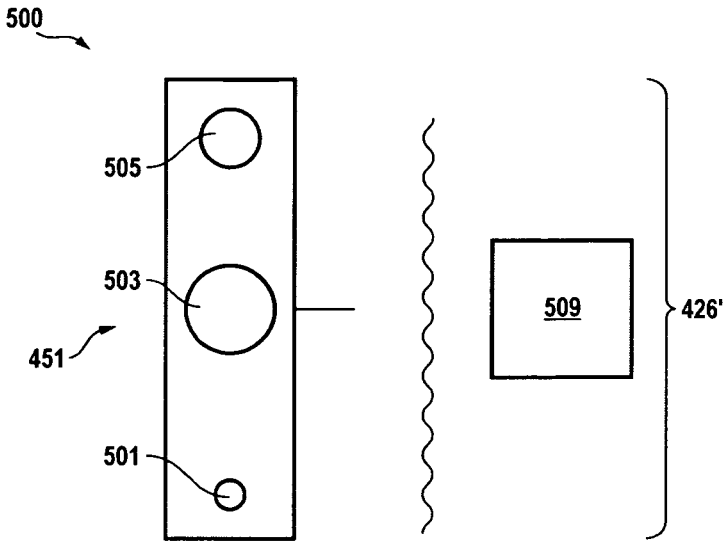
FIG. 5A shows schematic representation of a commissioning module for commissioning lighting devices within a wireless lighting network, in accordance with the embodiments of the invention.

FIG. 5A shows schematic representation 500 of the sensor or commissioning module 451 for commissioning one or more light fixtures 509 with one or more corresponding controller units 426'. In accordance with the embodiments of the invention the sensor or commissioning module 451 includes a light sensor 501, a motion sensor 503 a manual switch 505 and LED indicators. The motion sensor 503 is an infrared motion sensor, a ultrasonic motion sensor or any combination thereof. The motion sensor 503 is in communication with the one or more controller units 426' (FIG. 5A) and is configured to control the one or more lighting devices 509 based on detected motion.

Still referring to FIG. 5A, the sensor or commissioning module 451 also includes a manual switch 505. In operation when one or more lighting fixtures 509, such as one or more LED light fixtures 427 (FIG. 4B), is installed. Actuating the manual switch 505 instructs the micro-processor of the controller unit 426' to run firmware that allows the one or more lighting fixtures 509 to manually set the maximum light output of all of the lighting fixtures within the wireless group. When the group is being formed or has been reopened, the momentary switch may be pressed to initiate a set of commands to limit the output of all group members. During this process, each subsequent press or other command will reduce the maximum light output by a set increment on the immediate fixture and all group members. When the desired level is reached, the maximum light output can be set by initiating another command such as a press and hold command. This command sets the maximum level for the immediate fixture and all group members. When the lighting group is placed back into operational mode, the light output from the lighting fixtures will now not exceed the maximum setting. In the future, when new members join the group then this maximum level information will be shared with the new members of the group.

In an on-off dimming mode, the light fixtures 509 will power down to a dimmed level in the absence of detected motion by the motion sensor 503 for a first period of time or time delay. Then if no motion is detected by the motion sensor 503 for a second and longer period of time or time delay, the controller unit 426' powers the one or more lighting fixtures 509 to be off.

Figure 5B:
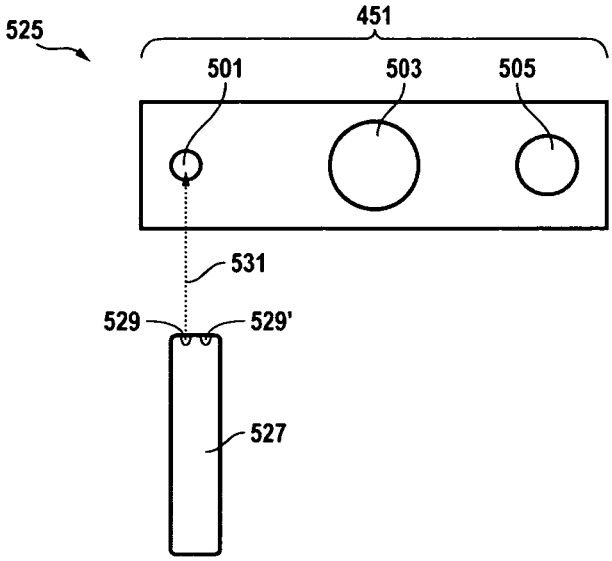
FIG. 5B shows a schematic representation of the commissioning module shown in FIG. 5A and a light source for generating visible light commissioning signals, in accordance with the embodiments of the invention.

FIG. 5B shows a schematic representation 525 of the sensor or commissioning module 451 in FIG. 5A and a hand-held light source 527 for generating visible light commissioning signals. Visible light refers to light with wavelengths between 390 and 750 nanometers, corresponding approximately to violet-blue to red light. The light sensor 501 shall be capable of reporting information about the spectral content of the visible light. For example, it may report the light intensity within specific portions of the visible spectrum. The light sensor 501 shall also differentiate and report high intensity mono-chromatic light, such as light 531 generated by the hand-held laser light source 527. Preferably, the hand-held laser light source 527 is a dual-color hand-held laser with a first laser 529 for generating laser light with a first color and a second laser 529' for generating laser light with a second color.

While the light sensor 501 described above is preferably responsive to high intensity mono-chromatic light, light sensors that are responsive to lower level visible light, such as light generated by an LED light source and/or images generated by a smart phone are also contemplated. Further, while the light sensor is preferably responsive to visible light commissioning signals with different colors, light sensors configured to be responsive to different light sequences, such as pulsed visible light commissioning signals, are also considered to be within the scope of the present invention.

Figure 6:
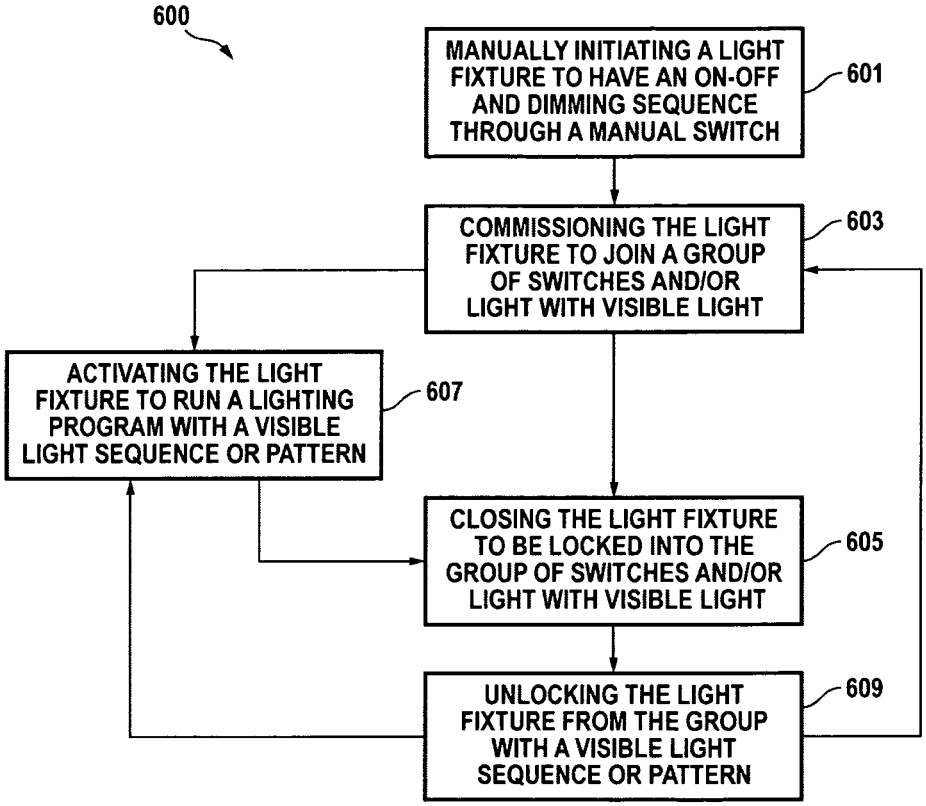
FIG. 6 shows a block-flow diagram outlining steps for commissioning lighting devices, in accordance with the method of the invention.

FIG. 6 shows a block-flow diagram 600 outlining steps for commissioning a lighting device, in accordance with a method of the invention. In a step 603, a lighting device is commissioned to create a new or join an existing group of lighting devices within a wireless lighting control network by irradiating a light sensor 501 (FIGS. 5A-B) on the lighting device with a first visible light signal from a light source, such as the dual-color hand-held laser 527 (FIG. 5B). The light sensor 501, then instructs the lighting device to join the group of lighting devices within the wireless lighting control network.

After the lighting device is commissioned to join the group of lighting devices in the step 603, then in a step 605 the lighting device is commissioned to be locked into the group and cooperatively operate with other lighting devices within the group in response to a condition by irradiating the light sensor 501 with a second visible light signal from the light source 527. Preferably, the first visible light signal and the second visible light signal have different wavelengths.

Still referring to FIG. 6, where the lighting device is a light fixture, prior to the step 603 of commissioning the device to join the group of lighting devices, in a step 601 a manual switch 505 on the commissioning module 451 is actuated. Actuating the manual switch 505 instructs the micro-processor of the controller unit 426' to run firmware to set the maximum light output and/or that places the light fixture in an on-off dimming mode, such as described in detail above.

Once the light fixture has been commissioned to join a group in the step 603 and commissioned to be locked into the group in the step 605, the light fixture can be un-locked from the group by irradiating the light sensor 501 with a visible light sequence or pattern. A step 609 of un-locking the light fixture, allows the light fixture to be re-commissioned to join a different group. The visible light sequence or pattern is, for example, a sequence of light pulses or predetermined bursts of light from the light source 527 (FIG. 5B). The sequence of light pulses or predetermined bursts of light help to provide a level of security to prevent the light fixture from accidentally be un-locked by and un-authorized person.

After the step 609 of un-locking the light fixture, or prior to the step 603 of commissioning the device to join the group of lighting devices, the lighting device is preferable capable of being commissioned to run a lighting program using a visible lighting sequence or pattern similar to that described with respect to a step 607 above.

The present invention has been described in terms of specific embodiments incorporating details to facilitate the understanding of the principles of construction and operation of the invention.

For example, while a single light sensor for sensing and responding to multiple visible light commissioning signals is disclosed, multiple light sensors with different sensitivities and/or different response to visible light commissioning signals with the same or different wavelengths is considered to be within the scope of the present invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A method of commissioning lighting devices to join a group of light fixtures within a wireless network, the method comprising:

transmitting group information over the wireless network;

receiving the group information via radio transceivers on the light fixtures;

irradiating light sensors on each of the lighting devices with a first visible light signal, thereby instructing each of the lighting devices to join the group; and irradiating at least one of the light sensors on the lighting devices with a second visible light signal thereby closing the group, each of the lighting devices within the group cooperatively operating in response to a condition, the first visible light signal and the second visible light signal having different wavelengths and being generated from a hand-held laser.

2. The method of claim 1, wherein the transmitting of the group information over the wireless network comprises actuating a momentary switch within the wireless network.

3. The method of claim 1, wherein at least a portion of the lighting devices include light fixtures and wherein a maximum light output of each of the light fixtures within the group is fixed by actuating a momentary switch on one or more of the lighting devices within the group.

4. The method of claim 1, further comprising irradiating a light sensor on a lighting device within the group with a visible light sequence from a light source, thereby instructing the lighting devices within the group to run one or more lighting programs stored in memory units on the lighting devices.

5. The method of claim 1, wherein at least one of the light fixtures within the wireless network includes:

a light engine; and a controller comprising:

a driver circuit for providing power to the light engine;

a controller circuit for controlling the driver circuit, the controller circuit including a micro-processor having firmware coded for instructing the light fixture and commissioning the light fixture to cooperatively operate with the lighting devices joined to the group of light fixtures within the wireless network; and a light sensor for receiving command signals from visible light signals, the light sensor coupled to the controller circuit for initiating the firmware of the micro-processor in response to the command signals to run and commission the light fixture to cooperatively operate with the lighting devices joined to the group of light fixtures.

6. The method of claim 5, wherein the light fixture further includes a motion sensor for controlling power to the light engine based on detected motion.

7. The method of claim 6, wherein the light fixture further includes a manual switch for initiating firmware from the micro-processor to set a maximum light output of the light fixture.

8. The method of claim 7, wherein the light sensor differentiates mono-chromatic light of different wavelengths.

9. The method of claim 5, wherein the light sensor is further responsive to receiving a light sequence from a visible light source to initiate firmware on the micro-processor to run one or more lighting programs stored on a memory unit of the light fixture.

10. The light fixture of claim 5, wherein the light sensor controls power to the light engine based on ambient light levels.

11. The method of claim 1, wherein the lighting devices within the group include one or more motion sensors.

* * * * *